US006155958A

United States Patent [19]

Goldberg

[11] Patent Number: 6,155,958

[45] **Date of Patent: *Dec. 5, 2000**

[54] STATIONARY EXERCISE BICYCLE HAVING A RIGID FRAME

[75] Inventor: Johnny Goldberg, Los Angeles, Calif.

[73] Assignee: Madd Dog Athletics, Inc., Santa Monica, Calif.

[ * ] Notice: This patent is subject to a terminal disclaimer.

[21] Appl. No.: 09/019,352

[22] Filed: Feb. 5, 1998

Related U.S. Application Data

[63] Continuation of application No. 08/736,976, Oct. 25, 1996, Pat. No. 5,722,916, which is a continuation of application No. 08/391,438, Feb. 21, 1995, abandoned, which is a continuation of application No. 07/969,765, Oct. 30, 1992, Pat. No. 5,423,728.

[51] Int. Cl.[7] ..... A63B 22/06

[52] U.S. Cl. ..... 482/57; 74/551.1

[58] Field of Search ..... 482/51, 57, 62, 482/63, 58; D21/194; 280/261; 297/195; 74/551.1

[56] References Cited

U.S. PATENT DOCUMENTS

| | | | |
|---|---|---|---|
| D. 291,462 | 8/1987 | Aalto | D21/194 |
| 562,198 | 6/1896 | Robinson | 482/52 |
| 588,166 | 8/1897 | Mccoy | 74/551.1 |
| 633,534 | 9/1899 | Read | 280/261 |
| 635,082 | 10/1899 | Stiles | 280/261 |
| 671,785 | 4/1901 | Young et al. | 482/57 |
| 1,336,774 | 4/1920 | Cooper | 482/57 |
| 1,507,554 | 9/1924 | Cooper | 482/57 |
| 1,636,327 | 7/1927 | Roe | 424/144 |
| 3,062,204 | 11/1962 | Stefano | 128/25 |
| 3,511,097 | 5/1970 | Corwin | 73/379 |
| 4,188,030 | 2/1980 | Hooper | 482/62 |
| 4,577,860 | 3/1986 | Matias | 272/73 |
| 4,632,386 | 12/1986 | Beech | 272/73 |
| 4,768,777 | 9/1988 | Yang | 272/73 |
| 4,772,069 | 9/1988 | Szymski | 297/195 |
| 4,824,102 | 4/1989 | Lo | 482/62 |
| 4,880,225 | 11/1989 | Lucas et al. | 272/73 |
| 4,902,001 | 2/1990 | Balbo | 482/62 |
| 4,915,374 | 4/1990 | Watkins | 272/73 |
| 4,936,570 | 6/1990 | Szymski et al. | 482/62 |
| 5,000,469 | 3/1991 | Smith | 280/261 |
| 5,145,477 | 9/1992 | Han | 482/57 |
| 5,232,422 | 8/1993 | Bishop, Jr. | 482/57 |
| 5,336,147 | 8/1994 | Sweeney, III | 482/57 |
| 5,423,728 | 6/1995 | Goldberg | 482/57 |
| 5,722,916 | 3/1998 | Goldberg | 482/57 |

*Primary Examiner*—Stephen R. Crow
*Attorney, Agent, or Firm*—Lyon & Lyon LLP

[57] ABSTRACT

A stationary exercise bicycle comprises a frame having front and rear ground support elements, a front socket and a rear socket, and a seat socket; a pedal mechanism on said frame and a seat mounted on a seat socket at a level above the pedal mechanism, the seat being mounted for movement fore and aft relative to the seat socket, and upwardly and downwardly relative to the pedal mechanism.

9 Claims, 5 Drawing Sheets

STATIONARY EXERCISE BICYCLE HAVING A RIGID FRAME

This is a continuation application of application Ser. No. 08/736,976, filed on Oct. 25, 1996, now U.S. Pat. No. 5,722,916 to Johnny Goldberg which is a continuation of application Ser. No. 08/391,438, filed on Feb. 21, 1995, now abandoned, which is a continuation of Ser. No. 07/969,765, filed on Oct. 30, 1992, now U.S. Pat. No. 5.423,728 to Johnny Goldberg.

BACKGROUND

Having a stationary exercise bicycle capable of simulating mountain bike riding is valuable.

This invention relates to a stationary exercise bicycle which is sturdy and comfortable for use during extended periods of pedaling while standing or sitting or a combination thereof and thus capable of meeting the needs of the more demanding rider.

In recent years, the popularity of the stationary exercise bicycle has increased dramatically together with the fitness craze. Stationary exercise bicycles are conventionally made with straight, brazed round tubing. A problem associated with using the round tubing in these bicycles is their propensity for fragility. They easily snap under increased stress, for example, during periods when the rider is pedaling in a standing position or in an alternating standing and sitting pedaling position. Also, the bicycle structure does not provide for the best flexibility according to the preferences of the rider.

There is a need to provide stationary exercise bicycle which is more durable and overcomes the problems of the prior art.

SUMMARY

The invented stationary exercise bicycle seeks to avoid the disadvantages associated with conventional stationary exercise bicycles.

According to the invention, the stationary exercise bicycle comprises a stable frame. Additionally, the frame comprises a front socket and a rear socket, and front and rear ground support elements. Also provided is a pedal mechanism on said frame.

Also, the bicycle comprises a detachable seat socket. A seat is mounted on a seat socket at a level above the pedal mechanism. The seat is mounted for movement fore and aft relative to the seat socket and upwardly and downwardly relative to the pedal mechanism.

Additionally, the stationary exercise bicycle comprises a handlebar mounted in the front socket. The handlebar includes at least two different handle means. One handle means includes spaced apart and outwardly directed elements. The second handle means includes an element inwardly located relative to the first handle means.

Further, in one preferred form, the frame comprises at least multiple upstanding posts. The posts are inter-engaging to form at least one triangulated structure between the ground support elements and one of the sockets.

Additionally, at least part of the front socket, rear socket, or seat socket are formed with a hollow member having a cross section which is non-cylindrical.

The pedal mechanism may include a cog operative with an endless chain having slots for engagement with the cog. A ring guard is provided and protective of at least the interaction of the teeth of the cog with the endless chain. The ring guard is located internally of the perimeter defined by the endless chain.

The invented stationary exercise bicycle is strong and comfortable for the rider. Moreover, it is stress-resistant so that it can be used by the rider in a standing position or in an alternating standing and sitting pedaling position for extended periods. Riders of this bicycle can simulate the aerobic effect of mountain bike racing.

Additionally, the invented stationary exercise bicycle is mobile and the parts easily replaceable. Unlike conventional stationary exercise bicycles, the present invention utilizes regular bicycle components. The user can replace certain parts from conventional bicycle shops and thus service the present invention with conventional bicycle componentry. Further, unlike prior art stationary exercise bicycles, the present invention has four basic parts which are detachable and can be placed in a portable transport carrier for mobility.

The invention is now further described with reference to the accompanying drawings.

DRAWINGS

Figure 1:
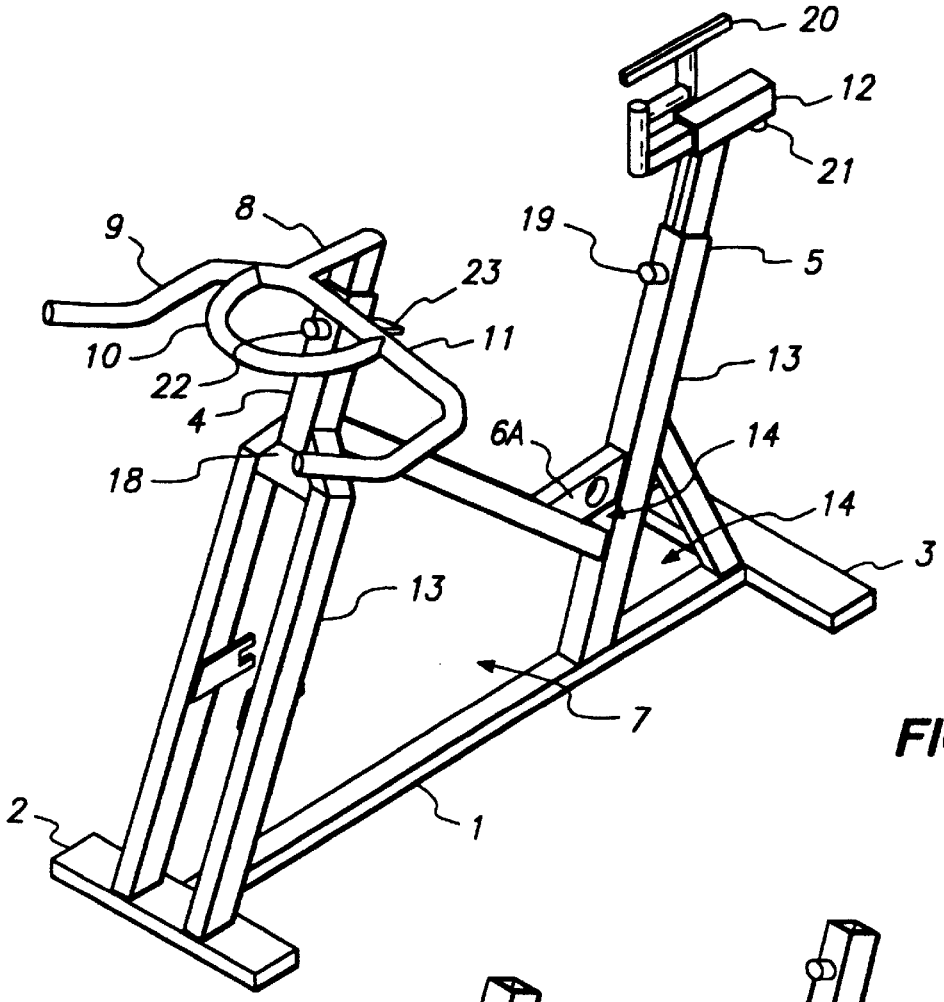
FIG. 1 is an isometric view of a frame for a stationary exercise bicycle.
Figure 2:
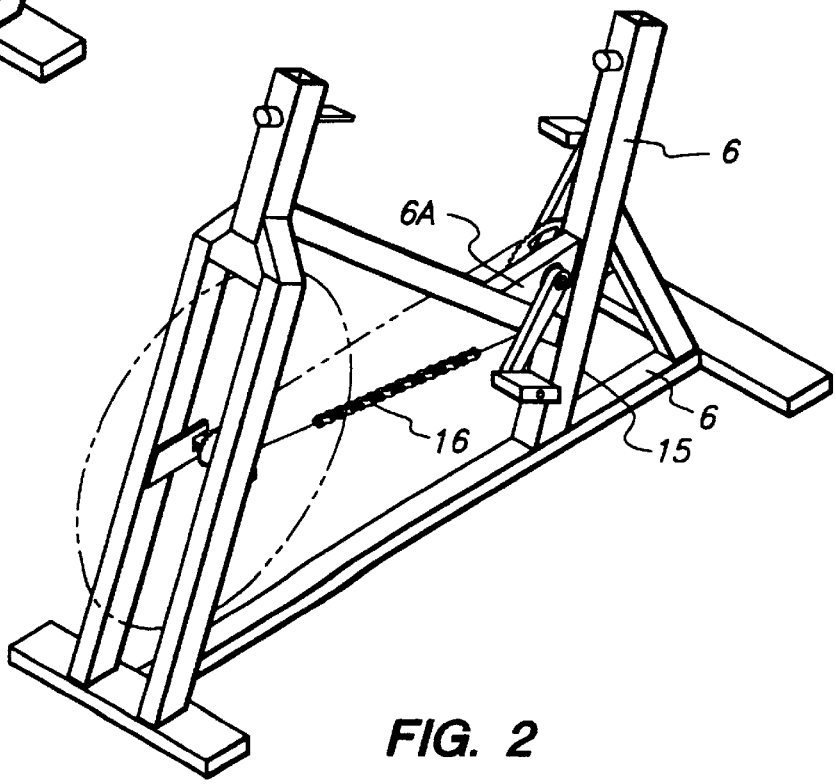
FIG. 2 is an isometric view of the pedal mechanism and a flywheel, both shown in phantom, including the ring guard, cog, and endless chain.
Figure 3:
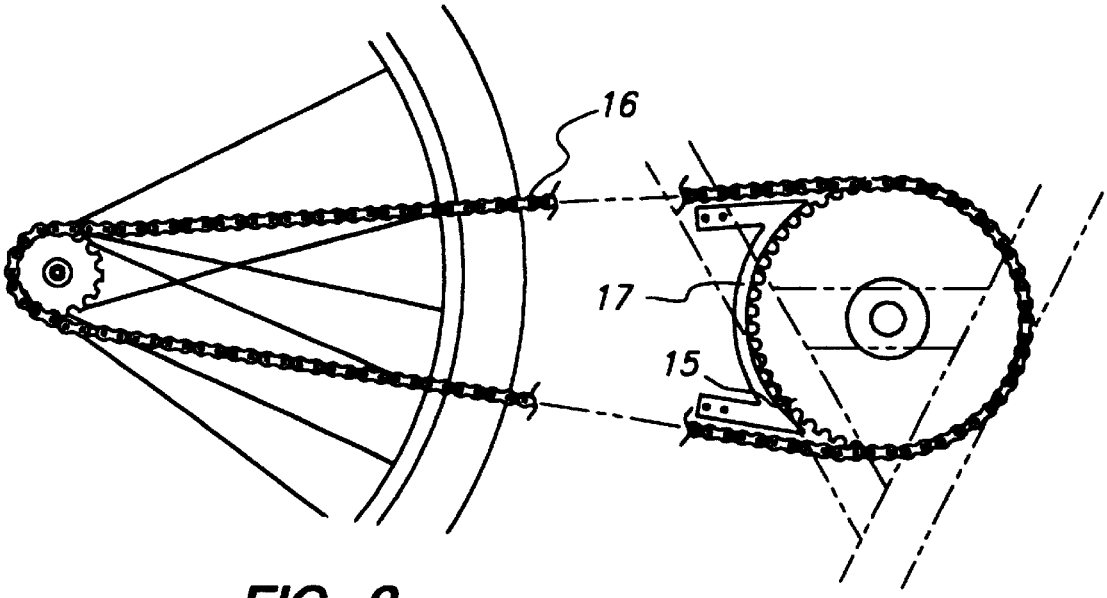
FIG. 3 is a detailed view of the ring guard in relation to the cog and frame.
Figure 4:
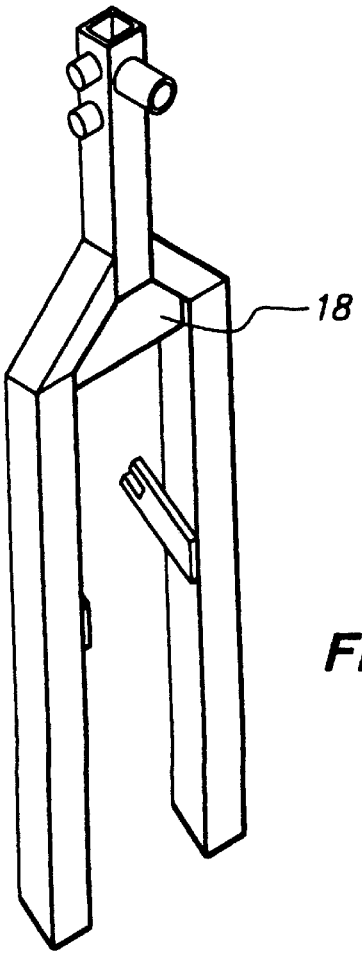
FIG. 4 is an isometric view of the front fork triangle and an upstanding post.
Figure 5:
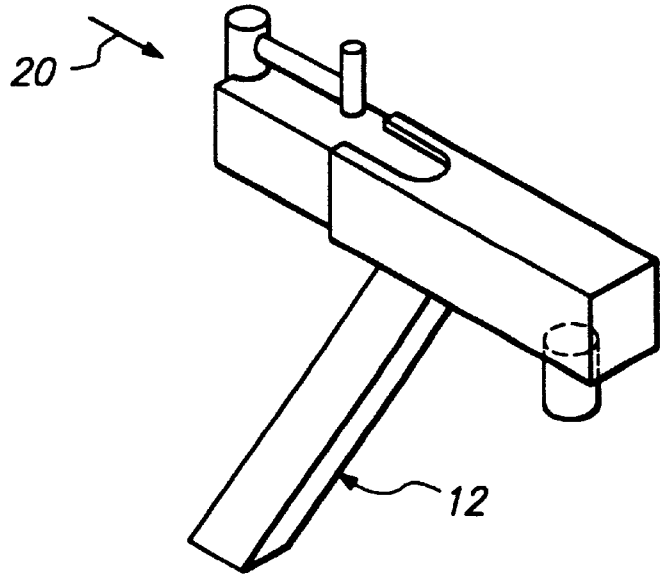
FIG. 5 is an isometric view of the seat socket and the connective member.
Figure 6A:
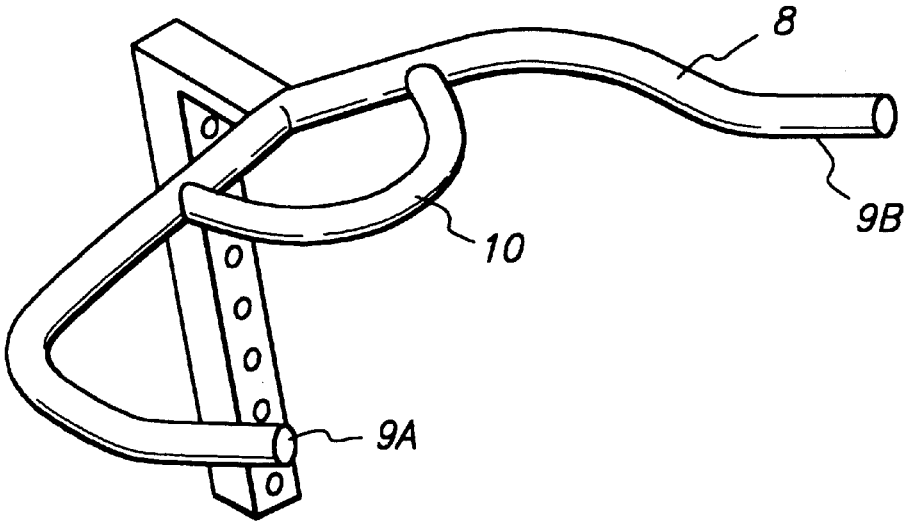
Figure 6B:
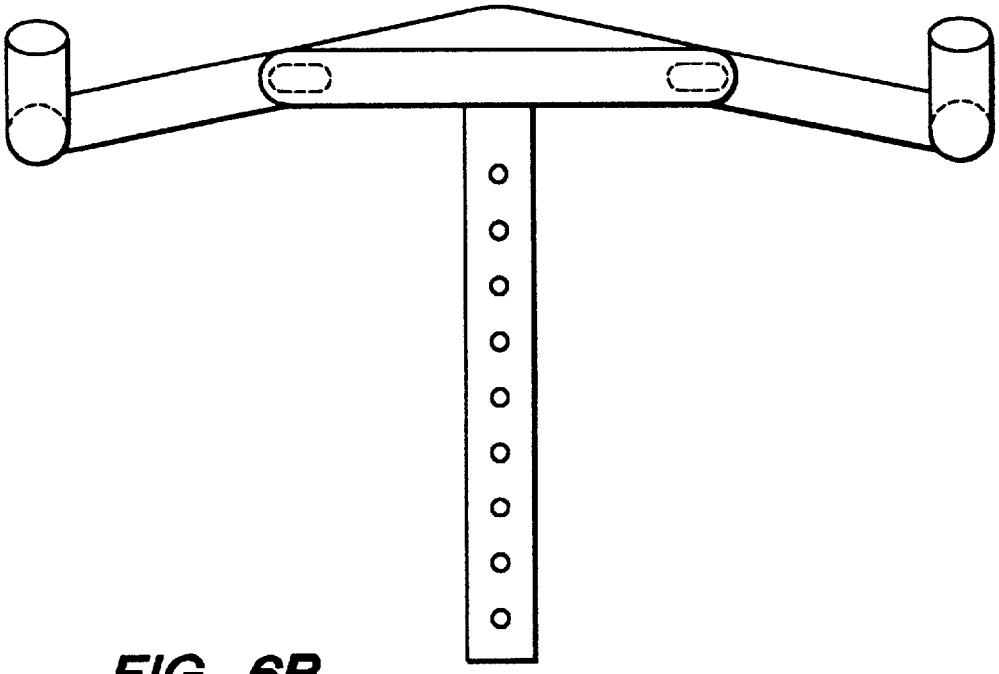
Figure 6C:
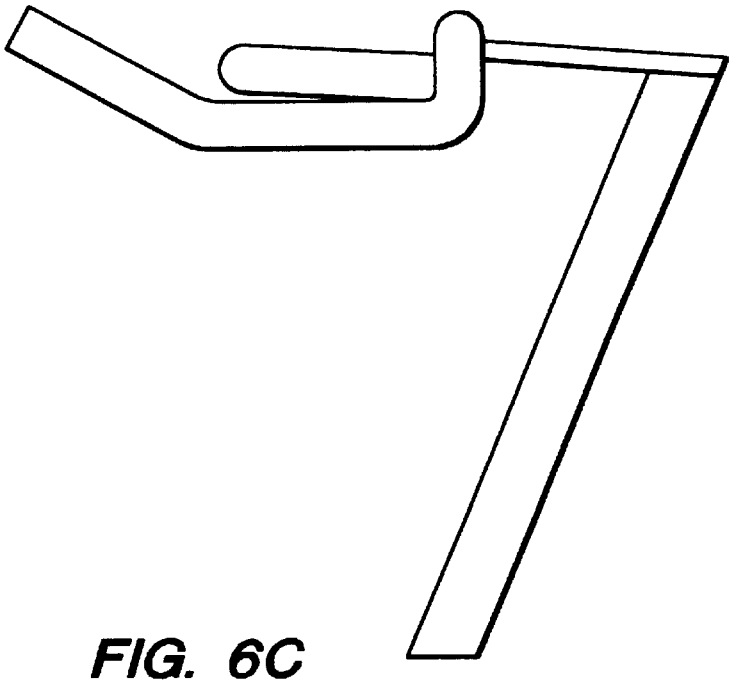

FIGS. 6A, 6B, and 6C are isometric, front and side views, respectively, of the adjustable and detachable handlebar including the forwardly extending prongs, the lateral bar, and the element inwardly located relative to the forwardly extending prongs.

Figure 7:
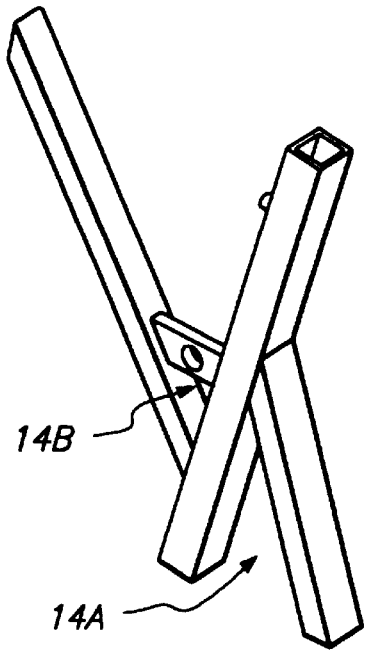

FIG. 7 is an isometric view of the triangulated structure portion of the frame.

Figure 8:
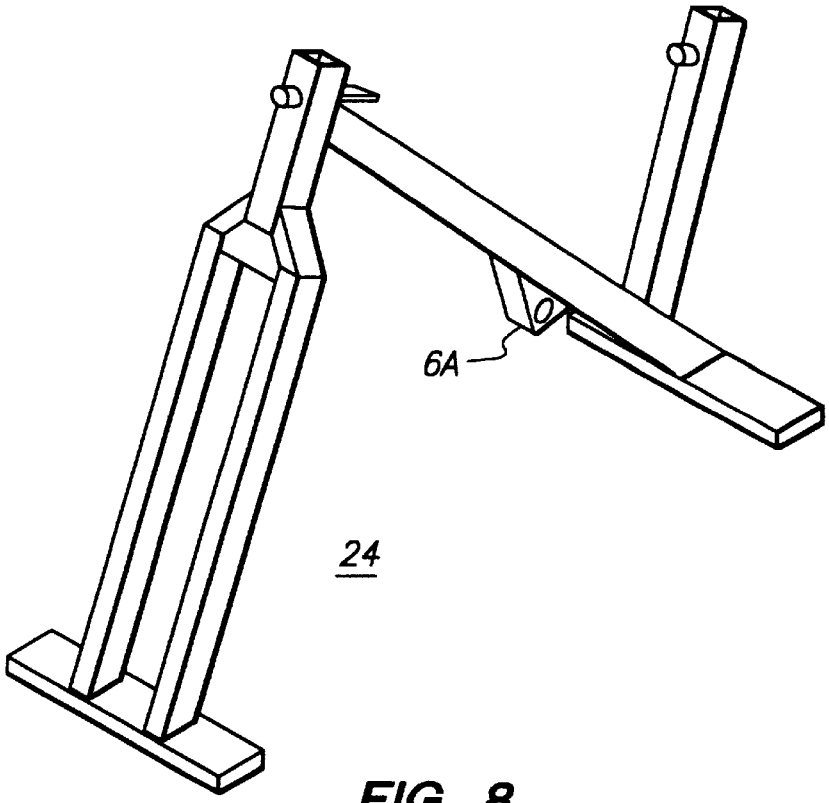

FIG. 8 is an isometric view of an alternative frame.

DESCRIPTION

A stationary exercise bicycle comprises a frame 1 or 24. The frame has front 2 and rear 3 ground support elements, a front socket 4 and a rear socket 5 and a pedal mechanism 6. The rear socket 5 is capable of receiving a seat socket 12. Further, a seat 20 may be mounted on the seat socket 12 at a level above the pedal mechanism 6. The seat 20 is mounted for movement fore and aft relative to the seat socket 12 and upwardly and downwardly relative to the pedal mechanism 6.

This stationary exercise bicycle further comprises a handlebar 8 mounted in the front socket 4. The handlebar 8 includes at least two different handle means 9 and 10. One handle means includes spaced apart and outwardly directed elements 9. The second handle means includes an element inwardly located 10 relative to the first handle means.

The outwardly directed handle means 9 have forwardly extending prongs 9A and 9B which are directed axially away from the seat socket 12. The axially directed prongs 9A and 9B are connected with a lateral bar 11 of the handlebar 8 at one end and are free at an opposite end.

The inner handle means 10 is at least part of a closed ring. The ring is located between the outer handle prongs. Further, the ring is connected to a lateral bar 11 of the handlebar 8.

The closed ring may be a semi-circle. The axis for the semi-circle is located substantially about midway through the lateral bar 11 of the handlebar 8.

The handlebars have been designed with the user's handlebar position needs in mind. Because of the need for the different hand positions during the ride, the ring allows for different hand positions, movements, quick transition from sitting to standing, and standing back to sitting. It also allows, without the use of an attached arm pad, the ability to lie the forearm on the ring portion of the handlebar and simulate a real training cycling position.

The handlebar 8 may be connected to the frame 1 by the front socket 4. A handlebar pop pin 22 permits adjustment of the handlebar 8 according to the requirements of the rider. FIGS. 6A, 6B, and 6C shows the holes which permit the connecting member to be arrestable by a pop pin for adjustment.

Applicant contemplates that alternative handlebars may be connected to the frame 1 or 24 in accordance with the rider's needs.

The frame 1 or 24 further comprises at least multiple upstanding posts 13. In a preferred form, the posts interengage to form at least one triangulated structure 14 between the ground support elements 2 or 3 and one of the sockets.

The frame 1 includes at least two triangulated structures 7 and 14 between the sockets 4, 5, and 12. The two triangulated structures 7 and 14 have at least one common upstanding post 13 forming at least one wall of the triangulated structure 7 and 14. One of the triangulated structures 7 and 14 includes an arm or cross element 6A intended to mount the pedal mechanism 6.

The upstanding posts 13 form part of the triangulated structure 7 and 14. Moreover, the upstanding posts 13 are all located at a non-horizontal, non-vertical axis.

The triangulated structures 7 and 14 include the rear triangle 14A which includes an inverted V-shaped section and which functions to stabilize the frame 1; the bottom bracket triangle 14B which includes an upstanding V-shaped section and which functions to stabilize the frame 1 so a rider can pedal standing; the front triangle-like structure 7 which includes an inverted V-shaped section which functions to permit total range of motion; and a front fork triangle 18.

The rear triangle 14A is important as a stabilizing block. Unlike conventional stationary exercise bicycles, the small base of this triangle gives the bike its total rigidity in the rear.

The bottom bracket triangle 14B gives the central part of the stationary exercise bicycle its rigidity and form for standing. Further, 6A allows for conventional pedal mechanisms (i.e. crankarm and crankset) to be used with a conventional clipless pedal or a regular bicycle pedal and toe clip.

The front triangle-like structure 7 is wide enough to house a flywheel. The front triangle-like structure 7 gives the stationary exercise bicycle its total range of motion moving the flywheel in an d out and giving the stationary exercise bicycle its base length or reel length from foot position to foot position.

The flywheel is connected to the frame 1 or 24 by the front fork triangle 18.

Further, at least part of the front socket 4, rear socket 5, or seat socket 12 are formed with a hollow member having a cross section being non-cylindrical. The sockets described herein permits a matingly shaped connecting member (such as the handlebar 8, the adjustable and detachable seat 20), the connecting member being arrestable by a pop pin 19, 21, or 22.

The hollow member may have a polygonal cross section (preferably quadratic). For example, in the illustrated example, the polygonal cross section is substantially square.

The seat is adjustable for height and connected to the seat socket 12. The seat post pop pin 19 permits height adjustment of the seat. The fore and aft saddle pop pin 21 permits adjustment of the seat 20 by sliding fore and aft in the seat socket 12.

Because of the adjustability of the seat and the handlebar a rider theoretically may have be as tall as 15 feet and weigh up to 900 pounds. The handlebar and seat adjustability provides for a versatile bicycle which can be used by persons of many different physiques, from small, light and short to large, tall and heavy.

The pedal mechanism 6 includes a cog 15 operative with an endless chain 16 having slots for engagement with the cog 15. Additionally, the pedal mechanism 6 includes a ring is guard 17 protective of at least the interaction of the teeth of the cog 15 with the endless chain 16. The ring guard 17 is located internally of the perimeter defined by the endless chain 16.

It would be desirable to provide attachments to the present invention. For example, a water bottle may be attached directly to the present invention or indirectly by means of a velcro device or any carrier means for attaching the water bottle to the stationary exercise bicycle.

Additionally, an ergometer may be attached to the present invention. Also, a computer controlled energy measuring and indicating device may be attached to the present invention.

The stationary exercise bicycle may comprise a dual chain tension device which is adjustable while the rider is in motion. Moreover, the stationary exercise bicycle may comprise a cable resistance braking system which permits the rider to adjust the resistance of the flywheel. A resistance plate 23 may support a cable to the flywheel.

The length and width of the stationary exercise bicycle is appropriate for standing and sitting while pedaling. Additionally, the width is appropriate for pedaling while sitting and for stabilization when the rider pedals while standing and rocking the body from side to side.

In a preferred form, the triangulated structures 14A, 14B, 7 stabilizes the stationary exercise bicycle. These triangulated structures form the "integrity" structure of the stationary exercise bicycle.

The symmetry of this machine is very basic. The genius in the present invention is in its simplicity. The present invention simulates road conditions exactly as if the rider is pedaling a conventional, non-stationary bicycle.

Applicant contemplates many other examples of the present invention each differing by detail only. For example, there are many variations of the sockets described herein. The sockets described herein may not only permit a matingly shaped connecting member to fit inside (such as the handlebar 8, the adjustable and detachable seat 20), the connecting member being arrestable by a pop pin 19, 21, or 22. In fact, the matingly shaped connecting member may be a hollow into which the socket fits, e.g. the rear, front, or seat socket.

Additionally, the handlebar 8 may include at least two different handle means. One handle means includes spaced apart and outwardly directed elements 9. The second handle means may include an element (e.g. a closed ring) outwardly located relative to the first handle means.

Further, in one form, the frame may have a plurality of segments. Instead of a single unit, the frame may collapse into several units which permits even greater mobility of the stationary exercise bicycle for transport. Each unit of the frame may be re-assembled using bolts or any other type of well known connecting means.

The above description and drawings are only illustrative. They are not intended to limit in any way the invention as set out in the claims which follow.

What is claimed is:

1. A stationary exercise bicycle that is adjustable to allow a rider to adopt different riding positions, the stationary exercise bicycle comprising:

(a) a frame having front and rear sockets;

(b) an adjustable seat mounted in the rear socket, the adjustable seat being extendable in fore and aft directions relative to the rear socket; and (c) a handlebar mounted in the front socket, the handlebar comprising a an upright portion lateral bar directed outwardly from the upright portion and prongs connected to the lateral bar and having forwardly extending free ends, the free ends extending upwardly to form handle portions, and at least one second bar extending forwardly in a common plane from said lateral bar, wherein the prongs comprise a length that is sufficiently long to allow a rider to reach and grasp the handle portions of the handlebar when the adjustable seat is in a fully extended fore position.

2. A stationary bicycle according to claim 1 wherein the adjustable seat comprises an adjustable seat support having a length that is sufficiently long to allow a rider to reach and grasp the lateral bar when the adjustable seat is set to a fully extended aft position.

3. A stationary bicycle according to claim 1 wherein said at least one second bar forms a ring in the space defined by the lateral bar and prongs to provide additional grasping positions for the rider.

4. The stationary bicycle according to claim 1 Wherein the lateral bar comprises two downwardly sloped elements each directed outwardly relative to the front socket.

5. An adjustable stationary bicycle comprising:

(a) a frame having ground supports, a seat holding mechanism, a handlebar holding mechanism, a frame structure connecting the seat holding mechanism to the handlebar holding mechanism, and a pedal assembly, wherein the frame structure comprises two V-shaped sections, one V-shaped section comprising two members and a substantially horizontal cross element connecting the two members intermediate the ends of the members, said pedal assembly mounted on said cross element, the other V-shaped section comprising members converging to a different point, wherein the two V-shaped sections overlap along a member, the member including one of the holding mechanisms;

(b) a handlebar assembly adjustably mounted on the handlebar holding mechanism, the handlebar holding mechanism capable of mounting the handlebar assembly at different positions relative to the frame, the handlebar assembly including a handlebar having multiple gripping positions; and (c) a seat assembly adjustably mounted on the seat holding mechanism, the seat holding mechanism capable of mounting the seat assembly at different positions relative to the frame, the seat assembly including a seat and a fore and aft adjustment mechanism to allow fore and aft movement of the seat relative to the frame.

6. The bicycle of claim 5 wherein said one of the holding mechanisms is the seat holding mechanism.

7. The bicycle of claim 5 wherein the seat holding mechanism comprises a socket.

8. The bicycle of claim 5 wherein one of the V-shaped sections is an inverted V-shaped section.

9. An adjustable stationary bicycle comprising:

(a) a frame having ground supports, a pedal assembly and a seat holding mechanism, the seat holding mechanism including (i) a bar with a polygonally shaped bore, (ii) a side aperture extending into the bore, and (iii) a locking member receivable within the side aperture;

(b) a handlebar adjustably mounted on the frame and adjustable relative to the frame in two directions;

(c) a seat assembly comprising (i) an attachment member including a first polygonally shaped portion and a second polygonally shaped portion angularly offset from the first polygonally shaped portion and including a bore, the first polygonally shaped portion receivable in the polygonally shaped bore of the seat holding mechanism and lockable therein at a plurality of positions by the locking member, (ii) a seat including a member receivable within the bore in the second polygonally shaped portion, and (iii) a locking mechanism, wherein the seat is slidably adjustable along the second polygonally shaped portion and lockable at a plurality of positions to adjust the seat in the fore and aft directions.

* * * * *

UNITED STATES PATENT AND TRADEMARK OFFICE

CERTIFICATE OF CORRECTION

PATENT NO. : 6,155,958

DATED : December 5, 2000

INVENTOR(S) : Johnny Goldberg

It is certified that error appears in the above-identified patent and that said Letters Patent is hereby corrected as shown below:

In the claims at column 5, line 17, claim 1 should read "comprising [a] an upright portion, a lateral bar directed".

In the claims at column 5, line 37, claim 4, the word "wherein" should begin with a lower case "w" rather than an upper case "W" as presently appears in the claim.

In the specification at column 3, line 56, the words "an d" should read as one word "and".

In the specification at column 4, line 18, the word "is" should be deleted.

Signed and Sealed this

First Day of May, 2001

*Attest:*

Nicholas P. Godici

NICHOLAS P. GODICI

*Attesting Officer*

*Acting Director of the United States Patent and Trademark Office*

US006155958C1

(12) EX PARTE REEXAMINATION CERTIFICATE (9587th)

United States Patent
Goldberg

(10) Number: US 6,155,958 C1
(45) **Certificate Issued: *Apr. 9, 2013**

(54) STATIONARY EXERCISE BICYCLE HAVING A RIGID FRAME

(75) Inventor: Johnny Goldberg, Los Angeles, CA (US)

(73) Assignee: Mad Dogg Athletics, Inc., Venice, CA (US)

Reexamination Request:
No. 90/012,192, Mar. 14, 2012

Reexamination Certificate for:

| | |
|---|---|
| Patent No.: | **6,155,958** |
| Issued: | **Dec. 5, 2000** |
| Appl. No.: | **09/019,352** |
| Filed: | **Feb. 5, 1998** |

Certificate of Correction issued May 1, 2001

( * ) Notice: This patent is subject to a terminal disclaimer.

Related U.S. Application Data

(63) Continuation of application No. 08/736,976, filed on Oct. 25, 1996, now Pat. No. 5,722,916, which is a continuation of application No. 08/391,438, filed on Feb. 21, 1995, now abandoned, which is a continuation of application No. 07/969,765, filed on Oct. 30, 1992, now Pat. No. 5,423,728.

(51) Int. Cl.
*A63B 22/06* (2006.01)

(52) U.S. Cl.
USPC ..... 482/57; 74/551.1

(58) Field of Classification Search ..... None
See application file for complete search history.

(56) References Cited

To view the complete listing of prior art documents cited during the proceeding for Reexamination Control Number 90/012,192, please refer to the USPTO's public Patent Application Information Retrieval (PAIR) system under the Display References tab.

*Primary Examiner* — Danton DeMille

(57) ABSTRACT

A stationary exercise bicycle comprises a frame having front and rear ground support elements, a front socket and a rear socket, and a seat socket; a pedal mechanism on said frame and a seat mounted on a seat socket at a level above the pedal mechanism, the seat being mounted for movement fore and aft relative to the seat socket, and upwardly and downwardly relative to the pedal mechanism.

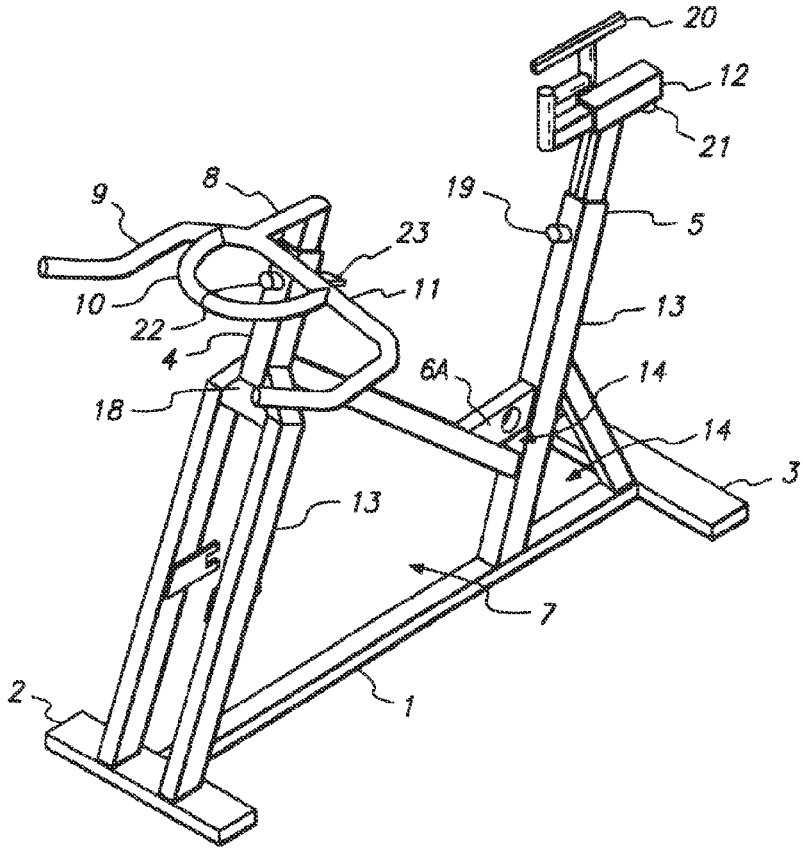

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 1-4 is confirmed.

Claim 9 is cancelled.

Claims 5-8 were not reexamined.

* * * * *